US007854811B1

(12) United States Patent
Wartman et al.

(10) Patent No.: US 7,854,811 B1
(45) Date of Patent: Dec. 21, 2010

(54) MOULDABLE PLASTIC EXPLOSIVES AND INERT SIMULANTS FOR MOULDABLE PLASTIC EXPLOSIVES

(75) Inventors: Albert Wartman, Thornhill (CA); Bruce Barak Koffler, Toronto (CA)

(73) Assignee: Kemzecur, Inc., Toronto (CA)

( * ) Notice: Subject to any disclaimer, the term of this patent is extended or adjusted under 35 U.S.C. 154(b) by 0 days.

(21) Appl. No.: 12/501,426

(22) Filed: Jul. 11, 2009

(51) Int. Cl.

| | |
|---|---|
| ***C06B 25/00*** | (2006.01) |
| ***C06B 25/34*** | (2006.01) |
| ***C06B 25/32*** | (2006.01) |
| ***C06B 25/04*** | (2006.01) |
| ***C06B 25/08*** | (2006.01) |
| ***D03D 23/00*** | (2006.01) |
| ***D03D 43/00*** | (2006.01) |

(52) U.S. Cl. ..... 149/109.6; 149/88; 149/92; 149/93; 149/105; 149/107; 149/109.4

(58) Field of Classification Search ..... 149/109.6, 149/88, 92, 93, 105, 107, 109.4
See application file for complete search history.

(56) References Cited

U.S. PATENT DOCUMENTS

| | | | | |
|---|---|---|---|---|
| 3,172,794 | A * | 3/1965 | Euder | 149/19.6 |
| 3,296,041 | A * | 1/1967 | Wright | 149/38 |
| 3,457,329 | A * | 7/1969 | Sherman et al. | 525/178 |
| 6,583,222 | B1 * | 6/2003 | Chaudhary et al. | 525/71 |
| 6,713,545 | B2 * | 3/2004 | Petiniot et al. | 524/224 |
| 6,732,545 | B2 * | 5/2004 | Cadet et al. | 65/17.2 |
| 6,932,878 | B1 * | 8/2005 | Hallam et al. | 149/19.91 |
| 2007/0008115 | A1 * | 1/2007 | Morhard et al. | 340/539.13 |

* cited by examiner

*Primary Examiner*—James E McDonough
(74) *Attorney, Agent, or Firm*—Richard Aron Osman

(57) ABSTRACT

A solvent-free process is used to make mouldable plastic explosives or mouldable plastic explosive simulant products.

20 Claims, No Drawings

MOULDABLE PLASTIC EXPLOSIVES AND INERT SIMULANTS FOR MOULDABLE PLASTIC EXPLOSIVES

The field of the invention is mouldable plastic explosives and simulants for mouldable plastic explosives

INTRODUCTION

Mouldable plastic explosives are powdered explosives compounds mixed in a plasticized polymer binder.

Mouldable plastic explosive simulants are powdered inert materials in a binder, resembling the general appearance, and having the x-ray signature and handling characteristics of the plastic explosive that they simulate. Inert simulants are used in the training of law enforcement, security and military personnel.

Existing mouldable plastic explosives (or their simulants) are mixtures of explosives (or simulants) bound in plasticized high molecular weight rubbery polymers, wherein the process of manufacture, a solvent must be used to achieve intimate mixing, and the solvent must then be removed.

Composition C4 is a widely-used and well-known plastic explosive; see, e.g K. C. Ottoson, U.S. Pat. No. 3,321,341, May 1967, assigned to Alliant Technologies. The C4 manufacturing process involves:

1. Preparation of a solution of polyisobutylene:

a) Cut the rubbery polyisobutylene slabs into smaller chips that are wetted with mineral oil, (SAE 10, with no additives).

b) These oiled chips are further comminuted by extrusion through a meat grinder type of equipment.

c) The oil-coated comminuted material is dispersed in a large excess of solvent (e.g. toluene) and slowly stirred until completely dissolved (dissolution may take 48 hours to complete).

2. The other ingredients in the formulation are added: (a) water-wetted RDX, (b) talc, and (c) dioctyl sebacate or dioctyl adipate, and the mixture is stirred to homogeneity.

3. The solvent (e.g. toluene) and the water are removed by azeotropic distillation under vacuum (the recovered solvent may be re-processed).

4. The resulting dough, Composition C4, is extruded and moulded into blocks for packaging.

Kenneth E. Lee, U.S. Pat. No. 6,887,324, May 3, 2005, entitled "Reformulation of Composition C4 Explosives", provides a method of loading the reformulated composition C4 through a relatively small orifice into the casing of an explosive device such as a warhead.

An example involves the mixing of 75 parts of 2 micron ground cyclotetramethylene tetranitramine or octogen (HMX) with 20 parts of poly-dimethylsilicone fluid at 25 degrees C., and mixed until smooth. Lee states that it is possible to lower the viscosity of his explosive compositions by slurrying the compositions in a suitable liquid, such as heptane.

Friedrich-Ulm Diesenroth, in U.S. Pat. No. 4,405,534, Sep. 30, 1983, entitled, "Production of Plastic-Bonded Explosive Substances", describes a process for the production of a plastic-bonded explosive, wherein the binder is applied as an aqueous dispersion of polyurethane to a powdered explosive. After evaporation of the water, a granular polyurethane-coated, plastic-bonded explosive is obtained. The end product is rigid, not a mouldable plastic explosive.

Plastic explosives in current use or manufacture include:

USA—C4 (Composition C4)

United Kingdom—DEMEX, ROWANEX, PE4 and PW4

France—PE4, PLASTRITE (FORMEX P1)

Poland—PWM, NITROLIT

Germany—Sprengkörper DM12, (Sprengmasse, formbar)

Yugoslavia—PP-01 (C4)

Slovakia—CHEMEX (C4), TVAREX 4A

Austria—KNAUERIT

Sweden—Sprängdeg m/46

Czech Republic—Semtex

As examples, PE4 comprises: RDX 88.0%, Paraffin Oil 9.6%, Lithium Stearate 2.4%), wherein lithium stearate is a thickening agent for the paraffin oil. Semtex plastic explosives are based on mixtures of RDX and PETN, with plasticizers and binders. In one form of Semtex the formulation (in parts by weight) is:

| | |
|---|---|
| RDX | 26.0 |
| PETN | 51.0 |
| Hydrocarbon oil plasticizer | 11.0 |
| Polymer binder (HYVIS) | 2.0 |
| Anti-oxidant, colour, etc. | |

The manufacture of the other mouldable plastic explosives is similar to the manufacture of C4. The processes require, inter alia, preparation of a polymer solution in a solvent, mixing in powdered explosive, solvent distillation, heating, cooling, and solvent disposal. Costs include the distillation equipment and its maintenance, the residence time of the product in production, the storage and segregation of products, solvents, etc.

REFERENCES

1. Military Explosives, Department of the Army Technical Manual, TM 9-1300-214, September, 1984
2. Rudolf Meyer, "Explosives", 2nd Edition Verlag Chemie, 1981
3. SNPE, Société Nationale des Poudres et des Explosifs, Brochure Hexogene RDX, 1979
4. T. Urbanski, "Chemistry & Technology of Explosives", Pergamon Press, 1967
5. P. W. Cooper, "Explosives Engineering", Wiley-VCH, 1997
6. B. M. Dobratz, Ed., LLNL "Handbook of Explosives" UCRL, 1981
7. AMCP 706-177, "Engineering Design Handbook, Explosives Series, Properties of Explosives of Military Interest", US Army Material Command, Washington, D.C., 1971
8. U.S. Pat. No. 3,321,341 to Karl G. Ottoson, dated May 23, 1967.
9. U.S. Pat. No. 6,887,324 B2, to Kenneth E. Lee dated May 3, 2005.
10. U.S. Pat. No. 4,770,728, to Berg, et al and assigned to Dyno Nobel; Method For Coating High Energy Explosive Crystals, dated Sep. 13, 1988 describes manipulation and drying of powdered explosive using fluidized bed.
11. U.S. Pat. No. 4,405,534, to Friedrich-Ulf Deisenroth, dated Sep. 20, 1983
12. Convention on the Marking of Plastic Explosives for the Purpose of Detection, International Civil Aviation Organization, Montreal, Quebec, Mar. 1, 1991.

SUMMARY OF THE INVENTION

In our invention, a viscous liquid, optionally in the presence of a plasticizer, is used as a binder for the powdered explosives, or powdered explosive simulants. The viscous liquid binder may be a liquid polymer, or a non-polymeric, high-viscosity liquid such as a pinene resin (e.g. Sylvares TRA-25, as shown in example 5, below). No solvent (organic or aqueous) is used in this process, which greatly simplifies manufacturing and reduces cost of the final product.

The subject plastic explosives (or simulants) behave like the current commercial plastic explosives (or simulants), providing requisite malleability and adhesion to surfaces to which the plastic explosives (or simulants) should adhere, while also providing a) a significant cost reduction factor in equipment for the manufacturing process; b) a significant cost reduction in the product; and c) increased safety in manufacture by eliminating flammable and toxic solvents.

Accordingly, the invention provides a solvent-free process to make mouldable plastic explosives or mouldable plastic explosive simulant products, comprising the steps of:

(a) mixing the following ingredients to form a substantially homogeneous mixture:

(1-i) for plastic explosive simulant, an inert powder, such as pentaerythritol (in the range of 15-90%, preferably 65-90%); or (1-ii) for live plastic explosive, a powdered explosive, such as RDX, PETN, HMX, or TNT, etc., (in the range of 15-92%, preferably 70-92%);

(2) a viscous polymeric liquid binder such as LIR-30, or non-polymeric liquid binder, such as Sylvalite RE10L, Sylvatac RE 5N and Sylvares TRA 25 (a liquid alpha pinene resin), sufficient to agglomerate the granular particles into a continuum, (in the range of 5% to 60%, preferably 7-30%);

(3) optionally and preferably, a plasticizer (such as dioctyl sebacate, dioctyl adipate, etc.) sufficient to increase the plasticity and malleability of the product without substantially negatively affecting the adhesion of the product to surfaces, generally in the range of 1-10%, preferably 1-5%, (wt/wt) of the binder;

(4) optionally, a rheology modifier sufficient to provide increased thixotropy, increase resistance to sagging, and minimize separation of the liquid binder from the powdered explosive or simulant, in the range of 1-30% of the binder (preferably 1-5%), such as synthetic clays (e.g. Zeothix 265), natural clays, coated fumed silica, chemically-modified natural clays, synthetic silicates, natural or synthetic organic polymers and gums;

(5) a colouring agent sufficient to impart visually detectable, permanent, indelible colour to the product, such as Sudan IV for red colour; orange, carbon black, Solfort yellow, etc. are other suitable colouring materials;

(6) a volatile chemical taggant sufficient to be detectable in the product by instrumentation (e.g. ion mobility spectrometer), or by detector canine. Suitable taggants include 2,3-dimethyl-2,3-dinitrobutane (DMNB), ethylene glycol dinitrate (EGDN), etc., generally in the range of 0.01-0.5%, more usually 0.1-0.2%, and survives the claimed process sufficient to retain detectability in the product;

with the proviso that no solvent is used, as is the case with the current state of the art, (e.g. the Ottoson process);

(b) manipulating the mixture to a determined shape and size by extruding and cutting (or pressing the mixture into one or more moulds); and optionally (c) packaging the resultant shaped and sized product for shipping.

In particular embodiments, the invention provides a solvent-free process to make mouldable plastic explosives and mouldable plastic explosive simulant products.

In the case of a mouldable plastic explosive, the components are:

(1) a finely powdered explosive, preferably chosen from commercially available explosives, particularly RDX, in the range of 15-92%, preferably 70-92%. To maximize the concentration of the powdered RDX in the formulation, as shown in Example 7, a mixture of finer and coarser powdered explosive is used. For example, the ratio of 3 parts of coarse powder to 1 part fine powder gives the maximum concentration of powdered explosive in many embodiments;

(2) a viscous liquid, e.g. LIR 30, from commercially available viscous liquids, to act as the binder in the range of 5-60%, preferably 5-15%. The viscous liquid used may be specially designed to act as a binder;

(3) optional additives:

a. plasticizer, e.g. dioctyl sebacate or dioctyl adipate, among others, in the range of 0-15% of the weight of the viscous liquid binder; preferably the plasticizer is 5% of the weight of the viscous liquid binder;

b. optionally, a rheology modifier such as Zeothix 265, in the range of 1-30%, preferably in the range of 0-15% of the weight of the viscous liquid binder;

c. a colouring agent to identify the product;

d. a volatile chemical detection taggant material required under the ICAO Montreal Convention, 1991, 0.1 to 0.5% of the total weight of the formulation.

All the above components are introduced into the mixing equipment in their appropriate proportions, and mixed to homogeneity. The resulting dough is shaped by extrusion or moulding to its final shape and size. After packaging, labeling, etc., the plastic explosive is ready for shipping.

The simplicity of our new process is evident, as compared to the current process for the manufacture of mouldable plastic explosives, synthesis of C4—U.S. Pat. No. 3,321,341 to Karl G. Ottoson, dated May 23, 1967. For example, in the Ottoson process, as described earlier, the rubbery polymeric polyisobutylene is dissolved in a solvent to create a viscous solution of the polyisobutylene (the time required is about 48 hours for this solvating step); in our new process, there is no need to dissolve a binder. We use a viscous liquid, e.g. LIR 30 as it comes from the manufacturer. This reduces the first step from 48 hours in the Ottoson process to zero.

Also in the Ottoson process, the polyisobutylene solution is mixed to homogeneity with the plasticizer, water-wetted, finely-powdered explosive and the various other ingredients. This is done in a suitable steam or oil heated mixer. Finally, the solvent and water are removed by azeotropic distillation. The resulting hot dough is cooled down before further processing.

In our new process, there is no solvent removal step. The distillation equipment and the cooling equipment are eliminated. The costs associated with these steps (distillation and cooling) are now non-existent. The costs associated with this equipment and its maintenance are greatly reduced. The size of the manufacturing plant is reduced, comparable to the Ottoson process plant. The net savings are evident. The time in process in the current state of the art is also greatly reduced by our new process.

Elimination of the solvent and solvent reprocessing, solvent storage, eventual solvent disposal, hazards built in with solvents (fire and explosion potential, toxicity), are further benefits to our new process. The associated cost savings are evident. In wartime production of plastic explosives, the cost and time savings are critical issues. Overall, our new process reduces production time from over 48 hours to 2 hours at most, as achieved in our scale of production.

In the case of inert simulants of mouldable plastic explosive, the formulation is the same as for the live mouldable plastic explosives, except that:

i) The real explosive is replaced by an inert powdered simulant, e.g., pentaerythritol. Other inert powdered simulants of real explosives (such as urea, monosodium glutamate, etc.) may also be chosen. An inert powdered explosive simulant shows an X-ray signature, and other signatures corresponding to the live product, as detected by certain other detection instrumentation, including canine detection. The addition of permissible taggants under the ICAO Montreal Convention, 1991, ensures detection by instrumentation and trained detector canines.

ii) Calculating and substituting the relative amounts of inert powder simulant for the powdered explosives in the formulations, the new formulation is based on the relative densities of the two powders; for the live powdered explosives: e.g., RDX, d=1.77 and for the inert simulant, e.g., pentaerythritol, d=1.396. For explosives other than RDX (TNT, PETN, HMX, etc.), other density substitutions are required.

It is a simple procedure to manipulate the mixture to a predetermined shape and size by extruding and cutting, or pressing the mixture into moulds, and eventually, to package the resultant shaped and sized product for shipping.

DESCRIPTION OF PARTICULAR EMBODIMENTS OF THE INVENTION

The subject plastic explosives consist of a dispersion of powdered explosives in a binder, with the physical attributes of a hand mouldable dough. Simulants are made using essentially the same processes as the live product, but with substitution of inert filler powders in place of the live explosive materials. Hence, simulants have the same characteristics as the live product.

Suitable liquid polymers operate as binders, and are generally low molecular weight homopolymers, copolymers, block and graft copolymers, condensation polymers, polyesters, polyamides, polyurethanes, hydroxy-terminated polybutadienes, etc. Suitable binders can also be viscous liquids such as pinene resins, rosin esters and other non-polymeric binder products. The important characteristic of the binders is being a viscous liquid at room temperature, and preferably in the range from −20 to +50° C. Suitable, commercially available liquid polymers and viscous liquids include:

(a) liquid isoprene rubber (LIR), is available from Kuraray Company in many grades, with different molecular weights and/or chemical compositions.

(b) liquid natural rubber (DPR), liquid synthetic rubber (Isolene) and liquid butyl rubber (Kalene) are each available in many viscosities. These products are made by Elementis (London, UK).

(c) liquid polyisobutylene, in 212 grades of viscosities, are a line of products from Texas Petrochemicals.

(d) poly-BD, polybutadienes are hydroxyl terminated liquid polymers from Sartomer. They are used in the production of polyurethanes.

(e) Wintack 10, is a viscous and tacky liquid, available from Goodyear Chemicals.

(f) Versamid 115, Versamid 125 and Versamid 140 are liquid polyamides based on dimer acids and various amines, made by Cognis.

(g) vinyl polymers and condensation polymers, such as liquid polyester can be designed to be viscous liquids, as used in printing inks (h) nonpolymeric liquid resins, such as liquid alpha pinene resin (e.g. Sylvares TRA25) and liquid rosin esters (e.g. Sylvalite RE10L, Sylvatac RE5N, Arizona Chemicals);

Viscous liquid polymer and viscous liquid compounds as binders instead of rubbery or leathery polymer binders, do not need a solvent in process.

Examples of suitable liquid isoprene rubbers used in our experimental examples are:

LIR 30 (MW 29,000)
LIR 50 (MW 47,000)
LIR 290 (MW 25,000)
LIR 310 (MW 30,000)
LIR 403 (MW 25,000)
LIR 410 (MW 25,000)

The corresponding melt viscosity (poise) at 38° C. for the above LIR liquid polymer are:

740 for LIR 30,
4,800 for LIR 50,
9,500 for LIR 310,
3,000 for LIR 390,
10,000 for LIR 290,
980 for LIR 403,
1,800 for LIR 410

The binders are generally present in the composition at levels from 5% to 60%.

In our procedure, the preparation of plastic explosives is quite simple: a liquid polymer, mixed with a rheology modifier, and finely-powdered explosive, or explosive simulant are blended together in a mixer.

In experimental examples 2 and 7 the rheology modifier was omitted. The resulting content of explosive or inert simulant fillers was higher. The malleability and adhesion were acceptable.

Process Notes:

A) A dry powdered explosive is an intermediate stage, in a fluidized bed process, as in U.S. Pat. No. 4,770,728 to Berg, Alf; Bjorlo, Olav E.; and Ulsteen, Kare, on Sep. 13, 1988.

B) By mixing coarse and fine particles, the highest concentrations of explosives are achieved.

A dimension of thixotropy can be obtained with the addition of a rheology modifier to increase resistance to sagging, and reduce separation of the liquid binder from the powdered explosives, generally up to 30%. In some versions of our formulation, no rheology modifier was added and the product still showed a satisfactory dimension of thixotropy. Thixotropy is the reversible behaviour of certain gels that liquefy when they are shaken or stirred. In the present process, plastic explosives (or explosive simulants) are dimensionally stable at rest, and become malleable when kneaded or manipulated.

Rheology modifiers can be chosen from natural or synthetic clays. Natural and synthetic silicates could also be used. Coated fumed silica, is a commercial product of Cabot Corporation or Degussa Corporation; Zeothix 265, a product of Huber Corporation, is a rheology modifier for non-aqueous systems. Some synthetic organic polymers and gums (natural polymers) can also act as rheology modifiers and thickeners.

Recent additional requirements by end-users in the security field, are that simulants must have the correct x-ray signature and density and must contain chemical detection taggants, as in the live explosive. These taggants are volatile chemicals that can be sniffed by instrumentation and trained detector canines. No loss of taggant happened in our mixing procedure; (losses of taggant do occur in the Ottoson process for C4, when the solvent is removed by distillation under vacuum).

The addition of a taggant to plastic explosives is required by the ICAO Montreal Convention of 1991. For example, 0.1-0.2% 2,3-dimethyl-2,3-dinitrobutane (DMNB) is specified. Other acceptable taggants and their usage concentration, according to this Convention, are: 0.2% ethylene glycol dinitrate, 0.5% para-mononitrotoluene, and 0.5% ortho-mononitrotoluene.

For mixing at room temperature, in this new process, the taggant can be added as a crystalline solid or a liquid.

The resulting product mix shows good adhesion to surfaces. Good adhesion of a plastic explosive to a surface is considered acceptable, when the required amount for a demolition operation does not sag under its own weight, over a fixed time (e.g. 0.1, 1, 10, or 100 min).

The resulting product mix is also thixotropic. Thixotropy imparts structure to a gel at rest. When mechanically disturbed, the structure of the gel breaks down and the gel becomes a liquid. The process is reversible. Measurements of the viscosity using a Brookfield viscometer, will quantify thixotropy under varying shear rates. In the case of plastic explosives simulants and plastic explosives, the products are malleable but retain their shape when handling is discontinued.

The equipment in the new solvent-free manufacturing process of plastic explosives consists of either a high shear mixer, a horizontal dough mixer, a two-roll or three-roll mill, etc. Use of a sealed, covered mixer, eliminates possible losses of powdered explosive or simulant—an important issue for safety.

Final shaping of the product to correct dimensions (e.g. for packaging), is done through a mixing extruder, or by pressing in a mould.

Production temperature is generally room or ambient temperature, and can range from below 0 to 50° C.

After mixing, the product is extruded to proper shape, cut to size, or pressed into moulds, and packaged for shipping.

The claimed process simplifies prior art methods (e.g. the Ottoson process), which require the following or similar equipment:

a) a toothless saw blade on a bandsaw, to cut and comminute the large polymer blocks into smaller pieces falling into an oil-containing tank.

b) a meat grinder comminutes the oil-coated small pieces of polyisobutylene. The oil serves two purposes: it prevents the agglomeration of the smaller pieces back into bigger lumps; it also lubricates the worm gear and cutting blades, for smooth passage through the equipment.

c) dissolving and mixing tanks, to dissolve the comminuted and oil-coated polymer in a solvent. After homogenization, the plasticizer is added. The plasticizer increases handleability, the capacity to be physically handled or manipulated while minimizing product residue transfer, e.g. to the mixing equipment or hands of the handler.

d) a suitable steam or oil heated mixer. Into the mixer are added the powdered explosive, as a slurry with water, followed by the taggant. After mixing to homogeneity, the next step is distillation.

e) the distillation equipment removes solvent and water (and incidentally removes some of the taggant). Distillates are collected in holding tanks and somehow processed for storage and re-use.

f) An extruder, through which the product, C4, is extruded to proper shape and size for shipping.

Additional items to the equipment above for this Ottoson process are:

- piping, and control valves connecting between different parts of the equipment pumps to move the contents in the pipes vacuum pumps
- transfer pumps for the transfer of heating or cooling fluids monitoring equipment for control of temperature, pressure, etc.
- a steam generator, in the case of steam heating.

Without further detailing on the capital cost of this equipment, it can be seen that considerable savings are achieved with our new process, as compared to prior arts.

In view of these advantages and description, our invention provides:

- A process which reduces production time from over 48 hours to 2 hours at most, as achieved in our scale of production. The resulting cost savings are evident.
- A process which eliminates hazardous operations in production: such as heating, distillation, solvent transport and storage, taking into consideration the presence of explosives and other flammables.
- The elimination of eventual disposal of unusable streams of production such as off-spec. solvents, and associated costs. Increasingly stringent environmental protection regulations have made production under the Ottoson process very costly.
- A process which eliminates the dangers of explosion due to unpredictable solvent vapour leaks, solvent spills and uncontrollable conditions, such as overheating, which may occur.
- A process that drastically reduces human exposure to solvents containing perhaps carcinogenic components.

EXAMPLES

To generate an inert simulant for C4, the very viscous liquid isoprene rubber (LIR-30), from Kuraray, was chosen as a binder. LIR-30 combined with powdered inert material, creates a product similar to C4. It shows a positive x-ray signature, similar to that of the real explosive. It also displays good mouldability and adhesion properties.

Various additives are described in the section covering the experimental details, including a thixotropic agent such as Zeothix 265 (a synthetic clay) and a plasticizer, such as dioctyl sebacate or dioctyl adipate.

In our process, all the ingredients were mixed in a dough mixer at room temperature. The operation took less than two hours including weighing, mixing and discharging the product from the mixing bowl.

We concluded that the same process for making the simulants of C4 and simulants of other plastic explosives, can be used to manufacture live plastic explosives by a new and simpler solvent-free process, that is also cost effective compared to the Ottoson process.

The formulation of the explosive mixture is readily calculated, taking into account the different densities of the powdered inert simulant and the powdered explosive.

Example 1

Into the stainless steel bowl of a 20-quart Hobart dough mixer, is weighed 1,000 grams of LIR 30, 150 grams of Zeothix 265 and 2,683 grams of pentaerythritol. (70% pentaerythritol in the formulation). After mixing, the end product has acceptable malleability and adhesion.

Substituting the inert simulant pentaerythritol with RDX, to create a plastic explosive, the calculated amounts are: 1000 grams of LIR 30, 150 grams of Zeothix 265, and 3,383 grams of RDX. (74.7% RDX in the formulation).

Larger amounts of filler (either pentaerythritol or RDX as the case may be) may be used, but the mixture becomes stiffer as the amount of filler is increased.

Example 2

To 1,000 grams of LIR 30 (without Zeothix 265) was added powdered pentaerythritol. The resulting mixture contains a significantly higher concentration of pentaerythritol. (The larger amount of pentaerythritol takes the place of the Zeothix 265 in this formulation). The mixture is malleable and the adhesion is acceptable. With further increase of the filler, the mixture, as expected, becomes less malleable.

Example 3

The procedure described in example 1 is repeated, with 1,000 grams of Wintack-10 (in place of the LIR 30), 150 grams of Zeothix 265, and 2,683 grams of pentaerythritol. The product obtained is acceptable, for its malleability and adhesion.

Example 4

The procedure described in Example 1 is repeated. A taggant material, 2,3 dimethyl-2,3 dinitrobutane (DMNB) was added in powder form at a level of 0.1% to 0.2%, as required by the Montreal Convention of 1991 on the addition of taggants to plastic explosives (International Civil Aviation Organization).

In the cold mixing process, there is no loss of taggant by evaporation. Some loss of taggant occurs in the current Ottoson C4 process, at the stage of distillation of solvent and water.

Example 5

The procedure described in example 1 is repeated, using 1,000 grams of Sylvares TRA-25 in place of the LIR 30. The product obtained in this example has better adhesion than the product obtained with LIR 30.

Example 6

The procedure described in example 1 was repeated using LIR 30 1,000 grams, dioctyl sebacate 50 grams, and pentaerythritol 3,515 grams (77% in the formulation).

The product has good adhesion and is very malleable.

By replacing the inert filler pentaerythritol with RDX explosive, a concentration of 80.9% of RDX is calculated in the formulation.

NOTE 1: The density of RDX is 1.77 grams/cc, and the density of pentaerythritol is 1.396 grams/cc. These numbers are used in the calculations when formulating live plastic explosives.

NOTE 2: To make other plastic explosive simulants of Semtex-H, Semtex S1A, Semtex 10, DM12 Sprengkörper, some dyes and colouring agents were used, such as Sudan IV, Solfort Yellow YH5778, orange colour dye and carbon black.

NOTE 3: Liquid Isoprene Rubbers (LIR) are available in many grades. LIR 50, LIR 290 and LIR 310 are all liquids with much higher viscosity than LIR 30. While LIR 30 and LIR 50 are homopolymers, some other LIR products are copolymers (with styrene, for example) or block copolymers. Other types of LIR are constantly coming on stream at Kuraray. The above LIR products are viscous liquid oligomers, while the polyisobutylenes used in the current C4 formulation are high molecular weight rubbery or leathery polymers.

NOTE 4: Formulations with dioctyl sebacate or dioctyl adipate as plasticizers in the formula (as in example 7), show better adhesion to metal surfaces, (even rusted steel), increased mouldability and reduced residue left on the hands after handling.

Other plasticizers may also be used, for example, the cheaper phthalate plasticizers.

NOTE 5: The simulant filler pentaerythritol, or the explosive filler RDX (hexogen) etc., are sometimes added in only one mesh size as described in the examples above; this does not maximize the possible concentration of filler.

By using two different mesh sizes of the same filler, the finer particles will occupy the voids that exist between the larger mesh size particles. The results of this experimental fact are shown in example 7.

Example 7

Use of two mesh sizes to maximize the filler content in the final product:

The procedure described in example 2 was followed; coarse pentaerythritol (a mixture of mesh sizes 40 to 100, from Aldrich Chemicals) was used, along with fine pentaerythritol (Hercules mono 200 pentaerythritol, finer than 200 mesh):

| | | | |
|---|---|---|---|
| Coarse pentaerythritol | (68%) | 950 grams | |
| Fine pentaerythritol | (32%) | 443.2 grams | |
| | | | 1,393.7 grams |
| Binder: | | | |
| LIR 30 | (95%) | 194.94 grams | |
| Dioctyl sebacate | (5%) | 10.26 grams | |
| | | | 205.2 grams |
| | | | 1,598.9 grams |

The above is a ratio of 2:1, coarse to fine material. In a ratio of 3:1, maximal density is achieved.

The resulting product was 87.17% as pentaerythritol in the simulant, corresponding to a calculated 89.6% as RDX for the live explosive. The calculation for this conversion is based on the relative densities of pentaerythritol and RDX.

The density of RDX is 1.77, and that of pentaerythritol is 1.396. The concentration of RDX in the product is increased to 89.6% (from 80.9%), when a mixture of mesh sizes is used.

As mentioned earlier, when dioctyl sebacate is added as a plasticizer into the formulations, the handling of the dough is improved through increased mouldability. There is also a reduction in the amount of residue left on the hands after handling.

It is understood that the examples and embodiments described herein are for illustrative purposes only, and that various modifications or changes in light thereof will be suggested to persons skilled in the art, and are to be included within the spirit and purview of this application and scope of the appended claims. All publications, patents, and patent applications cited herein, including citations therein, are hereby incorporated by reference in their entirety for all purposes.

What is claimed is:

1. A solvent-free process to make mouldable plastic explosives or mouldable plastic explosive simulant products, comprising the steps of:

(a) mixing at room temperature the following ingredients to form a substantially homogeneous mixture:

(1) a powdered explosive or inert simulant thereof in the range of 15-92% (wt/wt);

(2) a viscous liquid binder in the range of 5-60% (wt/wt);

(3) optionally, a plasticizer sufficient to increase the plasticity and malleability of the product without substantially negatively affecting surface adhesion of the product, in the range of 0.1-10% (wt/wt);

(4) optionally, a rheology modifier sufficient to increase thixotropy, increase resistance to sagging, and minimize separation of the liquid binder from the powdered explosive or simulant, in the range of 1-30% (wt/wt) of the binder;

(5) optionally, a coloring agent sufficient to impart visually detectable, permanent, indelible color to the product;

(6) a volatile chemical taggant sufficient to be detectable in the product by ion mobility spectrometer or by detector canine in the range of 0.01-1% (wt/wt), and survive the process to retain detectability in the product;

with the proviso that no solvent is used in the process;

(b) manipulating the mixture to a predetermined shape and size by extruding and cutting, or pressing the mixture into moulds, and optionally;

(c) packaging the resultant shaped and sized product for shipping.

2. The process of claim 1 wherein ingredient (1) is the powdered explosive that is RDX, PETN, HMX, or TNT.

3. The process of claim 1 wherein ingredient (1) is the simulant that is pentaerythritol, urea or monosodium glutamate.

4. The process of claim 1 wherein the viscous liquid binder is selected from (a) liquid isoprene rubber; (b) liquid natural rubber or synthetic rubber, (c) liquid polyisobutylene, (d) polybutadiene, (e) liquid polyamides based on dimer acids and diamines, and (f) nonpolymeric liquid resins or rosin esters.

5. The process of claim 1 wherein the viscous liquid binder is a liquid isoprene rubber.

6. The process of claim 1 wherein the viscous liquid binder is a liquid natural rubber or synthetic rubber.

7. The process of claim 1 wherein the viscous liquid binder is a liquid polyisobutylene.

8. The process of claim 1 wherein the viscous liquid binder is a polybutadiene.

9. The process of claim 1 wherein the viscous liquid binder is a liquid polyamide based on dimer acids and amines.

10. The process of claim 1 wherein the viscous liquid binder is a nonpolymeric liquid resin or rosin ester.

11. The process of claim 1 wherein the plasticizer is included and is dioctyl sebacate or dioctyl adipate.

12. The process of claim 1 wherein the rheology modifier is included and selected from synthetic clays, natural clays, coated fumed silica, chemically-modified natural clays, synthetic silicates, natural or synthetic organic polymers and gums.

13. The process of claim 1 wherein the taggant is 2,3-dimethyl-2,3-dinitrobutane (DMNB) or ethylene glycol dinitrate (EGDN).

14. The process of claim 1 wherein the coloring agent is included and the colour is Sudan IV, orange, carbon black, or Solfort yellow.

15. The process of claim 1 wherein the plasticizer is included and the rheology modifier is included.

16. The process of claim 1 wherein the plasticizer is included, the rheology modifier is included, and the coloring agent is included.

17. The process of claim 1 wherein the plasticizer is included, the rheology modifier is included, and the coloring agent is included, wherein:

the viscous liquid binder is selected from (a) liquid isoprene rubber; (b) liquid natural rubber or synthetic rubber, (c) liquid polyisobutylene, (d) polybutadiene, (e) liquid polyamides based on dimer acids and diamines, and (f) nonpolymeric liquid resins or rosin esters;

the plasticizer is dioctyl sebacate or dioctyl adipate;

the rheology modifier is selected from synthetic clays, natural clays, coated fumed silica, chemically-modified natural clays, synthetic silicates, natural or synthetic organic polymers and gums;

the taggant is 2,3-dimethyl-2,3-dinitrobutane (DMNB) or ethylene glycol dinitrate (EGDN); and the colour is Sudan IV, orange, carbon black, or Solfort yellow.

18. The process of claim 1 wherein the plasticizer is included, the rheology modifier is included, and the coloring agent is included, wherein:

the viscous liquid binder a liquid isoprene rubber;

the plasticizer is dioctyl sebacate or dioctyl adipate;

the rheology modifier is selected from synthetic clays, natural clays, coated fumed silica, chemically-modified natural clays, synthetic silicates, natural or synthetic organic polymers and gums;

the taggant is 2,3-dimethyl-2,3-dinitrobutane (DMNB) or ethylene glycol dinitrate (EGDN); and the colour is Sudan IV, orange, carbon black, or Solfort yellow.

19. The process of claim 1 wherein the plasticizer is included, and the rheology modifier is included, wherein:

the viscous liquid binder is selected from (a) liquid isoprene rubber; (b) liquid natural rubber or synthetic rubber, (c) liquid polyisobutylene, (d) polybutadiene, (e) liquid polyamides based on dimer acids and diamines, and (f) nonpolymeric liquid resins or rosin esters;

the plasticizer is dioctyl sebacate or dioctyl adipate;

the rheology modifier is selected from synthetic clays, natural clays, coated fumed silica, chemically-modified natural clays, synthetic silicates, natural or synthetic organic polymers and gums;

the taggant is 2,3-dimethyl-2,3-dinitrobutane (DMNB) or ethylene glycol dinitrate (EGDN); and the ingredient (1) is the powdered explosive that is RDX, PETN, HMX, or TNT.

20. The process of claim 1 wherein the plasticizer is included, the rheology modifier is included, and the coloring agent is included, wherein:

the viscous liquid binder is selected from (a) liquid isoprene rubber; (b) liquid natural rubber or synthetic rubber, (c) liquid polyisobutylene, (d) polybutadiene, (e) liquid polyamides based on dimer acids and diamines, and (f) nonpolymeric liquid resins or rosin esters;

the plasticizer is dioctyl sebacate or dioctyl adipate;

the rheology modifier is selected from synthetic clays, natural clays, coated fumed silica, chemically-modified natural clays, synthetic silicates, natural or synthetic organic polymers and gums;

the taggant is 2,3-dimethyl-2,3-dinitrobutane (DMNB) or ethylene glycol dinitrate (EGDN);

the colour is Sudan IV, orange, carbon black, or Solfort yellow; and the ingredient (1) is the simulant that is pentaerythritol, urea or monosodium glutamate.

* * * * *